US007637492B2

(12) United States Patent
Brügge

(10) Patent No.: US 7,637,492 B2
(45) Date of Patent: Dec. 29, 2009

(54) METHOD AND DEVICE FOR SEPARATING PRINTING PLATES FROM A STACK

(75) Inventor: Wolfgang Brügge, Molfsee (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/061,076

(22) Filed: Apr. 2, 2008

(65) Prior Publication Data

US 2008/0246209 A1 Oct. 9, 2008

(30) Foreign Application Priority Data

Apr. 5, 2007 (DE) ..... 10 2007 016 920

(51) Int. Cl.
*B65H 3/46* (2006.01)

(52) U.S. Cl. ..... 271/105; 271/90; 271/108

(58) Field of Classification Search ..... 271/90, 271/105, 107, 108
See application file for complete search history.

(56) References Cited

U.S. PATENT DOCUMENTS 5,033,730 A 7/1991 Davies et al.
5,984,296 A 11/1999 Fricke et al.
2004/0108649 A1* 6/2004 Ono et al. ..... 271/90
2006/0180983 A1 8/2006 Behrens et al.

FOREIGN PATENT DOCUMENTS

DE 195 22 901 C1 10/1996
DE 197 55 520 A1 6/1999
DE 10 2004 049 385 A1 4/2006

OTHER PUBLICATIONS

German Patent and Trademark Office Search Report, dated Dec. 4, 2007.

* cited by examiner

*Primary Examiner*—Patrick H Mackey
*Assistant Examiner*—Gerald W McClain
(74) *Attorney, Agent, or Firm*—Laurence A. Greenberg; Werner H. Stemer; Ralph E. Locher

(57) ABSTRACT

An apparatus and a method are provided for separating first and second flat objects from a stack in which the flat objects are provided substantially in pairs and differ from one another in terms of weight per unit area and/or flexibility. The apparatus includes at least one suction element for attracting the objects by suction, a drive apparatus for moving the suction element, and a control apparatus for controlling the drive apparatus. The control apparatus drives the drive apparatus such that the suction element is moved to a first position, in which the first object that has a lower weight per unit area and/or a greater flexibility than the second object is attracted by the suction of the suction element. The first position is at a minimum distance from a stack surface.

10 Claims, 1 Drawing Sheet

METHOD AND DEVICE FOR SEPARATING PRINTING PLATES FROM A STACK

CROSS-REFERENCE TO RELATED APPLICATION

This application claims the priority, under 35 U.S.C. §119, of German application DE 10 2007 016 920.7, filed Apr. 5, 2007; the prior application is herewith incorporated by reference in its entirety.

BACKGROUND OF THE INVENTION

Field of the Invention

The invention relates to a method for separating flat objects from a stack, the objects being attracted by suction by at least one suction element.

Furthermore, the invention relates to an apparatus for implementing the method.

For individual processing, flat objects stacked on one another to form a stack and in particular supplied in such a stack must first be separated and then fed individually one after another into a processing machine.

For the purpose of imaging in a printing plate exposer, printing plates are introduced individually into the exposer. For an economic operation, the printing plates are fed to the printing plate exposer in the form of a printing plate stack. The printing plate stack is normally located in a cassette, which is supplied to an apparatus for separating the printing plates. The apparatus for separating printing plates is often also called a loader or in particular a single cassette loader (SCN). In this apparatus, the printing plates are separated individually out of the cassette or a printing plate stack otherwise provided.

In order to protect the printing plates, these are usually divided in the printing plate stack by more flexible and lighter intermediate layers. For the purpose of separation of these two different objects, substantially provided in pairs in the stack, published, non-prosecuted German patent application DE 10 2004 049 385 A1, corresponding to U.S. patent publication No. 2006/0180983, proposes using suction elements, by which the different objects are attracted by suction, these suction elements being enclosed by a limiting device and the suction elements themselves having suckers which, during a suction operation, can be deformed from a position underneath the limiting device into a position above the limiting device. Because only the flexible intermediate layers are able to follow the sucker in the region above the limiting device, these are separated from the printing plates locally here, and the construction of the suction elements ensures that a continuous channel is formed in a plate edge region, in which channel the flexible intermediate layers are separated from the printing plate. In this region, air is able to get in between the flexible intermediate layer and the printing plate and the intermediate layer can be pulled off.

In the method known from this document, it is necessary for the suction element to make contact with the outer edging of the region of the printing plate in which attraction by suction is to take place. The solid edging is a rigid structure. The printing plate itself is also drawn onto this structure by the suction force of the sucker during the separating operation. As a result, it is possible for impairments to the printing plate to occur in this region.

BRIEF SUMMARY OF THE INVENTION

It is accordingly an object of the invention to provide a method and a device for separating printing plates from a stack that overcomes the above-mentioned disadvantages of the prior art devices and methods of this general type, which teaches an alternative or an additional separating device.

With the foregoing and other objects in view there is provided, in accordance with the invention, a method for separating flat objects from a stack, the flat objects include first and second objects being provided substantially in pairs differing from one another in terms of weight per unit area and/or flexibility. The method includes moving a suction element to a first position. At the first position the first object having a lower weight per unit area and/or a greater flexibility than the second object is attracted by suction provided by the suction element, and the first position is at a first vertical distance from a stack top side, so that the suction element does not make contact with the stack at the first position.

The fact that the suction element is moved to a first position, at which a first object having a lower weight per unit area and/or greater flexibility than a second object is attracted by suction by the suction element, and the first position is at a first vertical distance from the stack top side, so that the suction element does not make contact with the stack at this position, ensures that the separation of the first and second objects from the stack takes place. In addition, it is no longer necessary here to provide an appropriate rigid edging of a sucker of the suction element, which comes rigidly into contact with the top side of an object and thus possibly impairs the object.

In a further refinement of the method, provision is made for the suction element to be moved at a first speed from a second position, which is located above the first position as seen from the stack, to the first position, in which the first object is attracted by suction. This advantageously takes account of the fact that the first object has a weight per unit area or a flexibility which may be subjected to certain fluctuations. The distance which the first position has to have from the top side of the stack in order just to permit the first object to be attracted by suction is therefore not necessarily known. If, then, the suction element is moved away from a second position, then it will in any case assume the first position at some time and attract the first object by suction there, irrespective of the distance of the first position from the top side of the stack. In particular, provision is made in this case for the suction element to be moved from the second position to the first position at a relatively low speed.

In a development of the method, provision is advantageously made for the suction element first to be moved onto the stack so as to make contact, in order subsequently to be moved at a second speed from the stack to the second position and for the suction force of the suction element to be activated only in the region of the second position. In the region of the contact with the stack, brief activation of the suction element can additionally be provided for the detection of the stack surface.

In this way, it is advantageously possible, even without accurate knowledge of the exact position of the stack surface, to move to a second position which is at a certain minimum distance from the stack surface. The sucker is first brought up to the stack, the stack surface is detected at this point by appropriate contact and, by a movement of the suction element at a second speed, the suction element can be moved upward through a defined distance from the stack top side. In order to avoid attraction of an object by suction or else of two joint objects from the stack, provision is advantageously made here for the suction element not yet to apply suction, which is to say for the suction element to be deactivated to this extent. This advantageously avoids not only a first object being attracted by suction by the suction element on its own but also a second also erroneously being attracted by suction together with the first object. Such erroneous attraction by suction can occur, for example, as a result of the fact that the first object has a certain porosity; a suction force is then exerted on the second object through the first object. If, therefore, a suction element is placed on a first object so as to make contact with the suction force activated, then the suction element would also attract the second object through the first object by suction and, during a movement upward, would lift both the first and second object and lift these jointly off a plate stack. The joint lifting of the first and second object from the stack is advantageously avoided by the deactivated suction element during this making of contact.

Only in the region of the second position is the suction force of the suction element activated. In this case, the second position of the suction element is configured in such a way that in no case can a first or second object from the stack be attracted by suction; the suction force is inadequate for this. If, then, as already described, the suction element is moved in particular slowly in the direction of the stack into the first position, then the first position will be reached at some time, which position is determined by the fact that in its region a first object which is more flexible or lighter can be attracted by suction by the suction element. In order to accelerate this process, provision can in particular be made for the suction element to be moved at a second, relatively high, speed from the position making contact with the stack top side to the second position and to be moved at a first speed, which is considerably lower than the second speed, from the second position to the first position, so that the region in which a first object is attracted by suction by the suction element can be reached without it being possible for excessively rapid lowering of the suction element and therefore the possible making of contact between the suction element and the surface of a first or second object to occur. In particular, provision can be made in this case to detect that a first object has been attracted by suction by the suction element and, at this instant, for the movement of the suction element in the direction of the stack to be stopped. It is then known that, in this first position, a first object has been attracted by suction and the first object can then be separated from the region of the stack by the suction element or by other measures.

In a particularly advantageous embodiment, provision is made for the slow movement of the suction element downward to be implemented by this being carried out step by step.

In this case, a step of the suction element is intended to amount to 0.25 mm to 0.5 mm; between two steps a waiting time, e.g. 500 ms, is then always provided. This waiting time can advantageously also be used for further method steps.

In a particularly preferred embodiment, provision is made for a first or second object attracted by suction to be detected during the waiting time; sufficient time for this measuring operation is then provided.

In a further advantageous method step, provision is made for the suction element to be moved first at a third speed from a starting position to a position making contact with the stack. This ensures that, irrespective of the stack height, there is always a starting position for the suction element. From this position, as described, the suction element can first be moved down onto the stack and then, without any reference back to the exact starting position, can assume a well defined distance from the second position. In particular, since no accurate measurement is necessary here, it is possible to provide a relatively high speed at which the suction element is moved down onto the stack from the starting position.

In a further advantageous embodiment, provision is made for the third speed to be higher than the first speed or higher than the first and the second speed. In this way, the method can be configured in such a way that a low speed is provided only for the method step in which a first object is to be attracted by suction. The remaining process, which is to say the second and third speed, can in each case be higher than the first speed. In particular, the third speed can be the highest, since here the greatest difference in height has to be overcome by the suction element. It is precisely here that the method is accelerated by an accelerated movement of the suction element as such.

It relatively frequently occurs that the first object has already been separated from the second object or that there is no first object with a lower weight per unit area and/or a higher flexibility between two second objects. In this case, therefore, no first object will be attracted by suction at the first position. In order to permit further separation from the stack, which is to say the lifting of second objects off the stack, provision is advantageously made here that, when no first object has been attracted by suction in a region around the first position, the suction element is moved further in the direction of the stack until a second object is attracted by suction. In particular, it is possible here for the second object also already to be attracted by suction without the suction element having to be moved down onto the stack surface. To this end, provision can in particular be made for a threshold value for the first position to be stored, which specifies the distance from the first position, which is to say from the actual position of the suction element in relation to the stack surface, beginning at which it is possible to assume that there is no first object on the stack surface. Therefore, when this threshold value is reached, which is to say beginning from undershooting a certain distance from the suction element to the stack surface, it is detected that no first object has been attracted by suction in the region of the first position.

The method proves to be particularly advantageous when the first object used is flexible, substantially paper-like intermediate layers and the second object used is printing plates having a higher weight per unit area than the intermediate layers. In this case, the method can beneficially be used for the separation of printing plates, in particular for the separation of printing plates and intermediate layers in a cassette in a single cassette loader.

In order to achieve the object, an apparatus is provided, which is suitable for implementing the method according to the invention. The apparatus has a drive apparatus for moving the suction element and a control apparatus for controlling the drive apparatus, the control apparatus being configured in such a way that it drives the drive apparatus such that the suction element is moved into a first position, in which a first object having a lower weight per unit area and/or greater flexibility than a second object is attracted by suction by the suction element, this first position being at a minimum distance from the stack top side. The advantages of such an apparatus, which is constructed in such a way that a corresponding method can be implemented therewith, have already been described.

Furthermore, the apparatus is constructed in such a way that it advantageously has a control apparatus which is configured in such a way that it controls the drive apparatus such that the suction element is moved at a third speed from a starting position to a position making contact with the stack surface, the suction element is then moved at a second speed to a second position at a second distance from the stack surface, the suction element is then moved at a first speed from the second position to a first position at a first distance from the stack surface, the second distance being greater than the first distance and the third speed being higher than the first and/or than the first and second speed. The advantages which are achieved with such an appropriate apparatus have already been discussed with regard to the corresponding method.

Furthermore, a second detection device is advantageously provided to detect a contact between suction element and stack surface, and a suction force activation device is advantageously provided to activate the suction force of the suction element in the second position, the suction force activation device being configured in such a way that it ensures the activation of the suction force of the suction element in the region of the second position. In addition, by a brief activation of the suction force, as described, reliable detection of the stack surface can be ensured and, as also already described, the suction element can then be brought to a defined second distance of the second position from the stack surface.

Furthermore, there is advantageously a first detection device to detect a first or second object attracted by suction on the suction element. In this way, an object attracted by suction can be detected and an appropriate further procedure of the method according to the invention can be carried out.

Other features which are considered as characteristic for the invention are set forth in the appended claims.

Although the invention is illustrated and described herein as embodied in a method and a device for separating printing plates from a stack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1A, 1B, 1C, 1D, 1E:
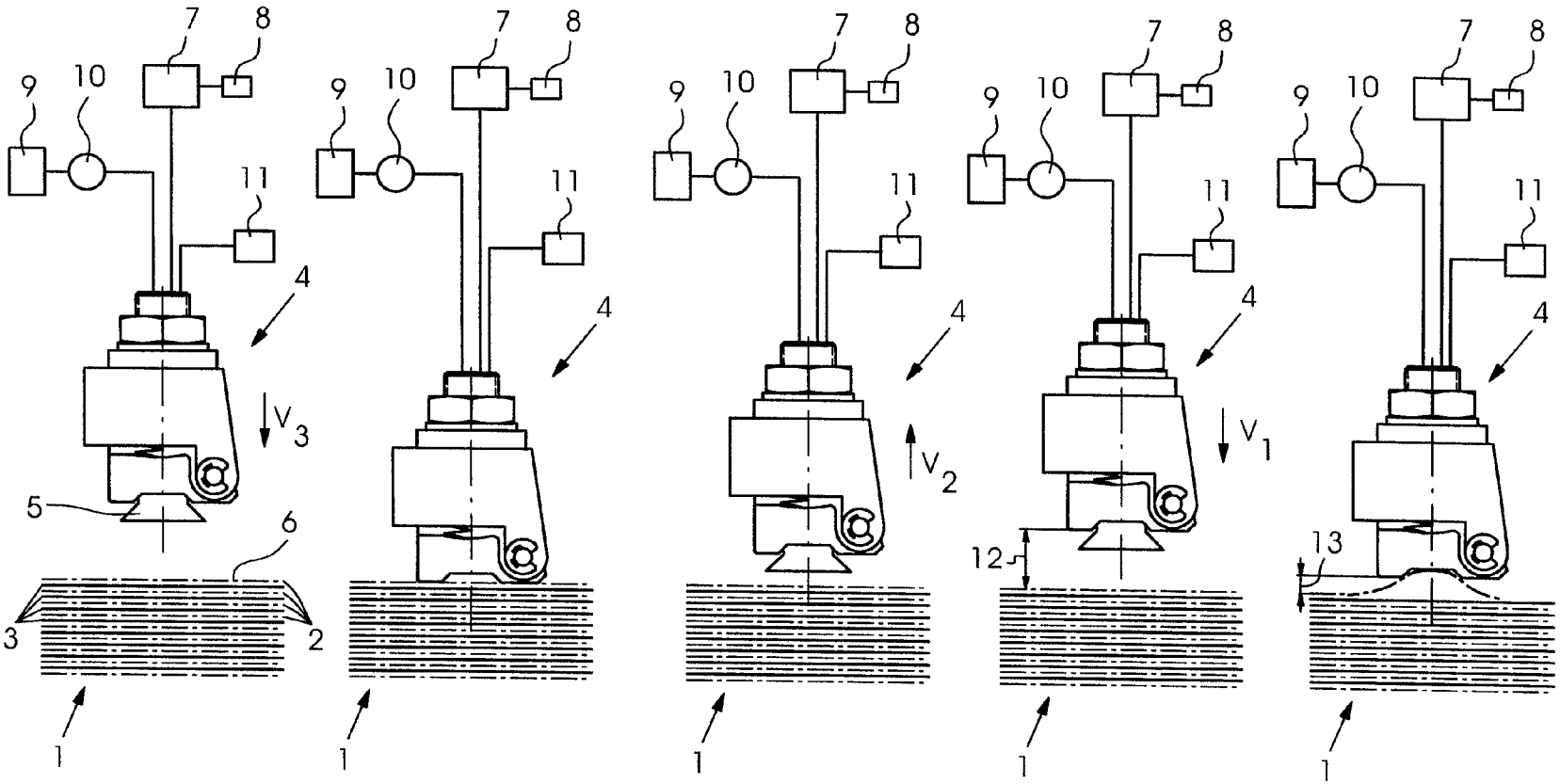
FIGS. 1A-1E are diagrammatic illustrations showing different positions and movement sequences over time of a suction element during a separation of printing plates and intermediate layers according to the invention.

Referring now to the figures of the drawing in detail and first, particularly, to FIG. 1A thereof, there is shown a printing plate stack 1, such as can be provided, for example, within a cassette in a cassette loader for a printing plate exposer, which are not illustrated here. The printing plate stack 1 substantially contains intermediate layers 2 and printing plates 3 in each case in pairs. The intermediate layers 2 are located between two printing plates 3, so that these cannot damage one another as a result of movements relative to one another. In the printing plate stack 1, the printing plates 3 and intermediate layers 2 are stacked substantially vertically on one another. A stack surface 6 is formed by the uppermost intermediate layer 2 or the uppermost printing plate 3, depending on which is present at the top on the printing plate stack 1.

A suction element 4 contains a sucker 5, which is driven by a suction force activation device 9. By use of the sucker 5, an intermediate layer 2 or a printing plate 3 can be attracted by suction. A complete apparatus for attracting intermediate layers 2 or printing plates 3 by suction, that is to say for separating printing plates 3 or intermediate layers 2 from a printing plate stack 1, always contains a plurality of suction elements 4 which are arranged in a line in such a way that they can attract a printing plate 3 by suction substantially at an edge which is not provided for an imaging process, and can separate it from the printing plate stack 1.

In order to move the suction element 4, which is to say substantially to move the suction element 4 toward or away from the printing plate stack 1, there is a drive apparatus 7, which is illustrated only schematically here. This drive apparatus 7 is driven via a control apparatus 8, which monitors the movement sequences of the suction element 4.

The suction element 4 also further contains a first detection device 10, by use of which an intermediate layer 2 or a printing plate 3 on the sucker 5 can be detected. The detection device 10 measures the pressure of a suction flow, which takes air in through the sucker 5 and in this way is able to attract an intermediate layer 2 or a printing plate 3 onto the sucker 5 by suction. If an intermediate layer 2 or a printing plate 3 is located directly on the sucker 5, then the latter is closed and a negative pressure builds up in the corresponding region of the suction element 4. This negative pressure can be detected by the first detection device 10 and, in this way, conclusions are drawn about the presence of an intermediate layer 2 or a printing plate 3.

Furthermore, the suction element 4 can also have a second detection device 11 in addition to the first detection device 10. By use of the second detection device 11, a position of the sucker 5, i.e. of the suction element 4, on the stack surface 6 can be detected. The second detection device can be, for example, a pressure sensitive sensor. Alternatively, sensors of the laser and photodiode type can also be imagined here.

However, it is also possible to dispense completely with a second detection device 11 for detecting a position of the suction element 4 on the stack surface 6. Then, the first detection device 10 can also be used to detect this position. For this purpose, the suction force activation device 9 can be switched on briefly, at least in the region of the stack surface 6, and the suction element 4 can be lowered onto the stack surface 6 at least at a speed which is sufficient to prevent an intermediate layer 2 or a printing plate 3 jumping onto the sucker 5. Then, the position of the suction element 4 on the stack surface 6 can also be detected here by a drop in the suction flow, i.e. the pressure in the suction element itself.

In the initial or starting position of the suction element 4 that is illustrated here, the sucker 5 is spaced relatively far apart from the stack surface 6. As illustrated by the arrow, the suction element 4 is lowered in the direction of the stack surface 6 at a third speed $V_3$.

FIG. 1B shows the same suction element 4 in a position in contact with the stack surface 6. As described, this position on the stack surface 6 can be detected either by the separate second detection device 11 or else by the first detection device 10 provided.

FIG. 1C shows the suction element 4 as it is moved at a speed $V_2$ away from the stack surface 6 from the position on the stack surface 6 and therefore away from the printing plate stack 1. The drive of the suction element 4 is in this case implemented via the drive apparatus 7. For this purpose, the drive apparatus 7 can in particular have stepping motors not further illustrated here. By counting the stepping motor cycles of the stepping motors, not illustrated here, it is possible to move the suction element 4 at a speed $V_2$ into a second position at a defined distance 12 from the stack surface 6.

In FIG. 1D the same suction element 4 is illustrated in the second position described, at a second distance 12 from the stack surface 6. The second distance 12 is intended to be 9 to 13 mm here, preferably 10 to 12 mm. In a preferred embodiment, the second distance 12 from an upper edge of the sucker, toward which the sucker 5 can be deformed during attraction by suction, as far as the stack surface 6 is about 10 mm. As illustrated by the arrow, the suction element 4 is moved in the direction of the stack surface 6 again by a speed $V_1$, starting from this second position. Before or as this movement sequence is initialized, however, the sucker 5 has a suction flow applied to it, which is activated by the suction force activation device 9. By use of the first detection device 10, a corresponding pressure in the region of a suction line, not illustrated here, can be detected.

Here, the speed $V_1$ is chosen to be very small, so that the point at which an intermediate layer 2 can be attracted by suction by the suction element 4 can be approached very accurately. For this purpose, the speed $V_1$ is chosen to be, in particular, substantially lower than the speed $V_3$. This low speed $V_1$ can also be implemented in such a way that the suction element 4 is always lowered by relatively small steps, for example of 0.25 or 0.5 mm. Following each individual step, a waiting time of, for example, 500 ms can then be provided in order to give the first detection sensor 10 sufficient time to detect whether an intermediate layer 2 has been attracted by suction by the sucker 5. This step by step lowering of the suction element 4 has the advantage that, by the waiting times provided, reliable detection of intermediate layers 2 on the suction head 4 is ensured.

If an intermediate layer 2 or a printing plate 3 on the suction element 4 is detected by the first detection device 10, provision can be made for the suction element 4 to be lowered once more by approximately 1 mm in order to hold the material securely on all the suckers involved.

FIG. 1E shows the suction head 4 when reaching the first position at a distance 13 between the suction element 4 and the stack surface 6. This distance 13 is sufficient for an intermediate layer 2 to have been attracted by suction by the sucker 5 of the suction element 4. As described, this state has been detected by the detection device 10 and the control apparatus 8 can then control the drive apparatus 7 appropriately in such a way that the suction element 4 is initially lowered by a small amount of 1 mm, for example, in order to hold the material securely, and is then moved away from the stack surface 6 such that the material attracted by suction, i.e. an intermediate layer 2 attracted by suction or a printing plate 3 attracted by suction, is separated from the printing plate stack 1.

During subsequent separating steps, in particular the action of moving the suction element back to a starting position, as illustrated in FIG. 1A, can be omitted.

As a result of moving down slowly at a speed $V_1$ from a second position at a distance 12 from the printing plate stack 1, accurate gripping of the intermediate layer 2 by the suction element 4 can be ensured. This is further improved substantially in particular by the suction element 4 being moved slowly toward the stack surface 6 by intermediate steps in a range from 0.25 mm to 0.5 mm. Intermediate layers 2 attracted by suction can then be detected still more reliably by the first detection device 10. Reliable separation of intermediate layers 2 and printing plates 3, in which in particular very thin intermediate layers 2 can be provided, can advantageously be ensured as a result.

The invention claimed is:

1. An apparatus for separating flat objects from a stack, the flat objects for separating including first and second objects being provided substantially in pairs differing from one another in terms of at least one of weight per unit area and flexibility, the apparatus comprising:

at least one suction element for attracting the objects by suction;

a drive apparatus for moving said suction element; and a control apparatus for controlling said drive apparatus, said control apparatus driving said drive apparatus such that said suction element is moved to a first position, in which the first object having at least one of a lower weight per unit area and a greater flexibility than the second object is attracted by said suction by said suction element, the first position being at a minimum distance from a stack surface;

wherein said control apparatus controls said drive apparatus such that said suction element is moved at a third speed from a starting position to a position making contact with the stack surface, said suction element is then moved at a second speed to a second position at a second distance from the stack surface, said suction element is then moved at a first speed from the second position to the first position at a first distance from the stack surface, the second distance being greater than the first distance and the third speed being at least one of higher than the first speed and higher than the first and second speeds.

2. The apparatus according to claim 1, further comprising:

a detection device for detecting contact between said suction element and the stack surface; and a suction force activation device for activating said suction of said suction element at least in the second position.

3. The apparatus according to claim 1, further comprising a detection device for detecting one of the first object and the second object attracted by said suction of said suction element.

4. A method for separating flat objects from a stack, the flat objects including first and second objects for separating being provided substantially in pairs differing from one another in terms of at least one of weight per unit area and flexibility, the method comprises the steps of:

moving a suction element to a first position, at the first position the first object having at least one of a lower weight per unit area and a greater flexibility than the second object being attracted by suction provided by the suction element, and the first position is at a first vertical distance from a stack top side, so that the suction element does not make contact with the stack at the first position;

moving the suction element at a first speed from a second position at a second distance from the stack top side to the first position, in which the first object is attracted by the suction, the second distance being greater than the first vertical distance; and implementing a first speed of the suction element by the first speed being lowered step by step, and after each step a waiting time of 500 ms is provided before the suction element is lowered again.

5. The method according to claim 4, which further comprises moving the suction element further in a direction of the stack until the second object is attracted by the suction if no first object has been attracted by the suction in a region around the first position.

6. The method according to claim 4, which further comprises:

using flexible intermediate layers as the first object; and using printing plates having a higher weight per unit area than the flexible intermediate layers as the second object.

7. The method according to claim 4, which further comprises lowering the first speed ($V_1$) by small steps of 0.25 to 0.5 mm.

8. A method for separating flat objects from a stack, the flat objects including first and second objects for separating being provided substantially in pairs differing from one another in terms of at least one of weight per unit area and flexibility, the method comprises the step of:

moving a suction element to a first position, at the first position the first object having at least one of a lower weight per unit area and a greater flexibility than the second object being attracted by suction provided by the suction element, and the first position is at a first vertical distance from a stack top side, so that the suction element does not make contact with the stack at the first position;

moving the suction element at a first speed from a second position at a second distance from the stack top side to the first position, in which the first object is attracted by the suction, the second distance being greater than the first vertical distance, wherein the suction element first makes contact with the stack, in order subsequently to be moved at a second speed from the stack to the second position, and in that a suction force of the suction element is activated at least when the suction element is at the second position;

moving the suction element at a third speed from a starting position to a position making contact with the stack; and setting the third speed to be one of higher than the first speed and higher than the first and the second speeds.

9. The method according to claim 8, which further comprises moving the suction element further in a direction of the stack until the second object is attracted by the suction if no first object has been attracted by the suction in a region around the first position.

10. The method according to claim 8, which further comprises:

using flexible intermediate layers as the first object; and using printing plates having a higher weight per unit area than the flexible intermediate layers as the second object.

* * * * *